US005713494A

United States Patent [19]

Kaiju et al.

[11] Patent Number: 5,713,494

[45] Date of Patent: Feb. 3, 1998

[54] POWDER FEEDING DEVICE

[75] Inventors: Haruhisa Kaiju, Kobe; Kenji Horita, Izumi, both of Japan

[73] Assignee: Matsuo Sangyo Co., Ltd., Osaka, Japan

[21] Appl. No.: 863,467

[22] Filed: May 27, 1997

Related U.S. Application Data

[63] Continuation of Ser. No. 510,615, Aug. 3, 1995, abandoned.

[30] Foreign Application Priority Data

Aug. 5, 1994 [JP] Japan ..... 6-184792
Oct. 21, 1994 [JP] Japan ..... 6-257055

[51] Int. Cl.[6] ..... B65D 83/00

[52] U.S. Cl. ..... 222/199; 222/637; 406/53; 406/56; 406/61; 406/79; 406/82; 406/109; 406/124; 406/134; 406/138

[58] Field of Search ..... 222/195, 196, 222/199, 202, 189.05, 200, 203, 226, 234, 263, 410, 413, 637, 412; 239/142, 654, 672, 675, 704; 406/52, 53, 56, 57, 61, 77–82, 89–91, 108–109, 122, 124, 134–138, 144, 146, 168, 173

[56] References Cited

U.S. PATENT DOCUMENTS

| | | | |
|---|---|---|---|
| 1,566,746 | 12/1925 | Herman | 222/200 |
| 2,800,252 | 7/1957 | Wahl | 222/196 |
| 3,134,513 | 5/1964 | Ashman | 406/138 |
| 4,024,985 | 5/1977 | Iinoya et al. | 222/410 |
| 4,353,668 | 10/1982 | Anderson | 406/138 |
| 4,591,075 | 5/1986 | Eriksson | 222/195 |
| 5,240,185 | 8/1993 | Kaiju et al. | 222/412 |

FOREIGN PATENT DOCUMENTS

| | | | |
|---|---|---|---|
| 2419235 | 11/1979 | France | 222/199 |

*Primary Examiner*—Philippe Derakshani
*Attorney, Agent, or Firm*—Wenderoth, Lind & Ponack

[57] ABSTRACT

A powder feeding device for feeding powder at a constant rate has a container for storing a powdered material and a discharge device mounted in the container at a lower portion thereof for discharging the powdered material from the container at a constant rate. A vibrator is mounted on the container or on a wire net mounted in the container to separate air from the powder. The powder may be supplied from a powder tank to the powder container.

10 Claims, 9 Drawing Sheets

POWDER FEEDING DEVICE

This application is a continuation of now abandoned application Ser. No. 08/510,615, filed Aug. 3, 1995 abandoned.

BACKGROUND OF THE INVENTION

This invention relates to a powder feeding device for feeding a powdered material, stored in a container, at a constant rate or volume, and more particularly to a powder feeding device capable of feeding a paint powder to a powder painting gun at a constant rate.

In order to provide a paint coating with a uniform film thickness by powder painting, it is extremely important to discharge a paint powder from the gun at a constant rate. For this purpose, conventional painting machines are provided with a screw feeder or a table feeder in or near the paint powder container so as to feed the paint powder paint to the gun at a constant rate.

In a line for continuous powder painting, every time the paint powder in a powder container needs replenishing, a fresh supply of paint powder is fed from a separate powder container or a paint powder tank.

This powder replenishment is done either automatically or manually. In a typical automatic powder re-supply operation, paint powder is carried together with air by an injector. The paint-air mixture is introduced into a mini-cyclone mounted on top of the powder container, where the paint is separated from air and dropped into the powder container. In a manual operation, a vinyl bag containing paint powder is taken out of a case, and air is introduced into the bag to loosen the contents. Then, the paint powder in the bag is emptied into the powder container.

The paint powder thus fed into the powder container inevitably contains air between the powder particles. According to the amount of air contained within the powdered material, the amount of paint per unit volume will vary.

Thus, it is difficult to discharge powder from the container at a constant rate even if a screw feeder or a table feeder is mounted in or near the container bottom.

It is known to introduce dehumidified, oil-free air into the powdered paint tank through its bottom in order to eliminate any lumps of powder and dehumidify the powder.

But the amount of air contained in the paint powder which is fed into the powder container from the powdered paint tank, differs widely according to the level of paint in the tank.

Namely, the smaller the amount of paint powder in the tank, the larger the amount of air contained in the paint powder.

Thus, in the actual powder painting line, the amount of paint powder discharged from the painting gun tends to drop gradually in proportion to the level of the paint powder in the tank as measured from the bottom of the tank, even if a constant-feed device such as a screw feeder or a table feeder is used.

FIG. 9 schematically shows a conventional paint powder feeder. This device has the above mentioned problem, i.e. the problem that the amount of paint powder discharged from the painting gun changes with the level of the paint powder in the tank (see FIG. 10). In FIG. 9, numeral 21 indicates a paint powder tank. The arrow 22 indicates the direction in which air is introduced into the tank 21. Numerals 24 and 25 indicate a powder container and an injector, respectively. The painting gun is indicated by numeral 26.

An object of this invention is to provide a powder feeding device which can discharge powder from a container at a constant rate irrespective of the amount of air contained in the powder supplied into the container.

SUMMARY OF THE INVENTION

According to this invention, there is provided a powdered feeding device for feeding a powder at a constant rate, including a container for storing a powdered material, a discharge device mounted in the container at its lower portion for discharging the powdered material in the container at a constant rate, and a vibrator mounted on the container.

By vibrating the powder in the powder container with the vibrator mounted on or in the powder container, it is possible to separate air contained in the powder from the powder, so that the amount of powder per unit volume becomes uniform at the lower portion of the container.

It is therefore possible to discharge powder from the bottom of the powder container at a constant rate with a content-rate discharge device such as a screw feeder or a table feeder.

Other features and objects of the present invention will become apparent from the following description made with reference to the accompanying drawings, in which:

DETAILED DESCRIPTION OF THE PREFERRED EMBODIMENT

The embodiments of the present invention are now described with reference to the drawings.

Figure 1:
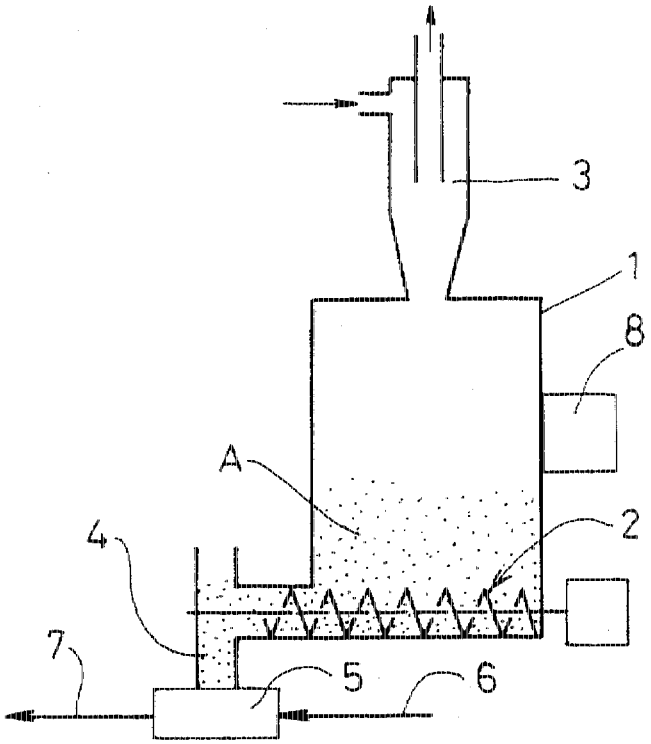
FIG. 1 is a schematic view of a first embodiment of the present invention.

In the first embodiment shown in FIG. 1, a screw feeder 2 is provided at the bottom of a powder container 1.

A cyclone 3 is provided on top of the powder container 1. A powdered material A is supplied into the powder container 1 through the cyclone 3.

An injector 5 is provided under a discharge port 4 formed in the bottom of the powder container 1, at the delivery end of the screw feeder 2. The injector 5 blows air 6 to carry the powdered material A, discharged from the screw feeder 2, to a powder coating gun through a hose 7.

A vibrator 8 is mounted on one side wall of the powder container 1. By activating the vibrator 8, its vibration is transmitted to the powder A in the container 1.

By vibrating the powder A, air filling the gaps between the particles of powder A escapes upwardly, so that the amount of powder A per unit volume becomes uniform at the lower portion of the container 1.

Thus, the screw feeder 2 can discharge a constant amount of powder A per unit time from the bottom of the container 1. For example, it is possible to stabilize the amount of powder discharged per unit time as shown in Tables 1 and 2. These Tables show the amounts of powder discharged from the coating gun when measured every 30 minutes, while discharging, with a screw feeder, a polyester (white) paint powder and an epoxy (black) paint powder from powder containers with and without the vibrator 8. In the powder container 1, equipped with the vibrator 8, the amount of powder discharged from the coating gun was very stable over time.

Figure 2:
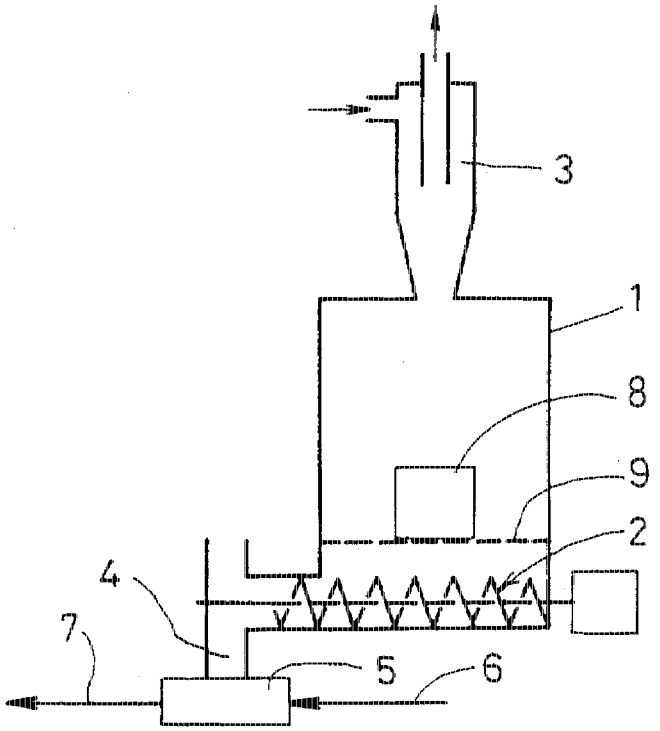
FIG. 2 is a schematic view of a second embodiment of the present invention.

A screw feeder 2 similar to the one used in the embodiment of FIG. 1 is also used in the second embodiment shown in FIG. 2 to feed the powder A.

In the second embodiment, a wire net 9 is stretched across the interior of the powder container 1. The vibrator 8 is mounted on the wire net 9. By vibrating the wire net 9 with the vibrator 8, vibrations are transmitted to the powder A, so that air present between the particles of the powder A escapes upwardly. Other elements, i.e. the cyclone 3, discharge port 4, injector 5, carrier air 6, and hose 7 are the same as in the embodiment shown in FIG. 1.

Figure 3:
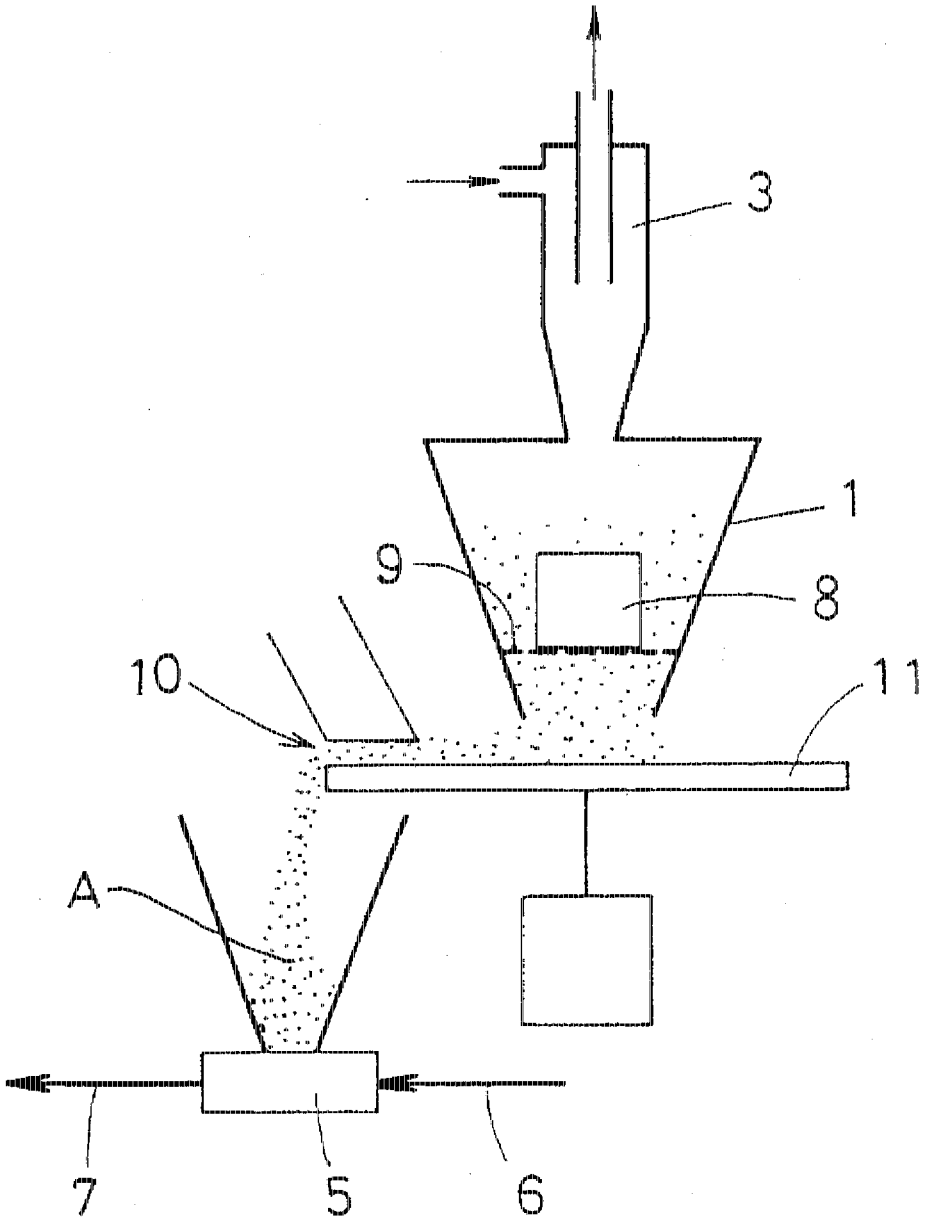
FIG. 3 is a schematic view of a third embodiment of the present invention.

In the third embodiment shown in FIG. 3, a table feeder 10 is used to feed powder. A powdered material stored in a hopper type powder container 1 is discharged onto a table 11. A wire net 9 is stretched across the interior of container 1. The vibrator 8 is mounted on the wire net 9. The remaining elements, i.e. the cyclone 3, injector 5, carrier air 6, and hose 7 are the same as those in the embodiment shown in FIG. 1.

Figure 4:
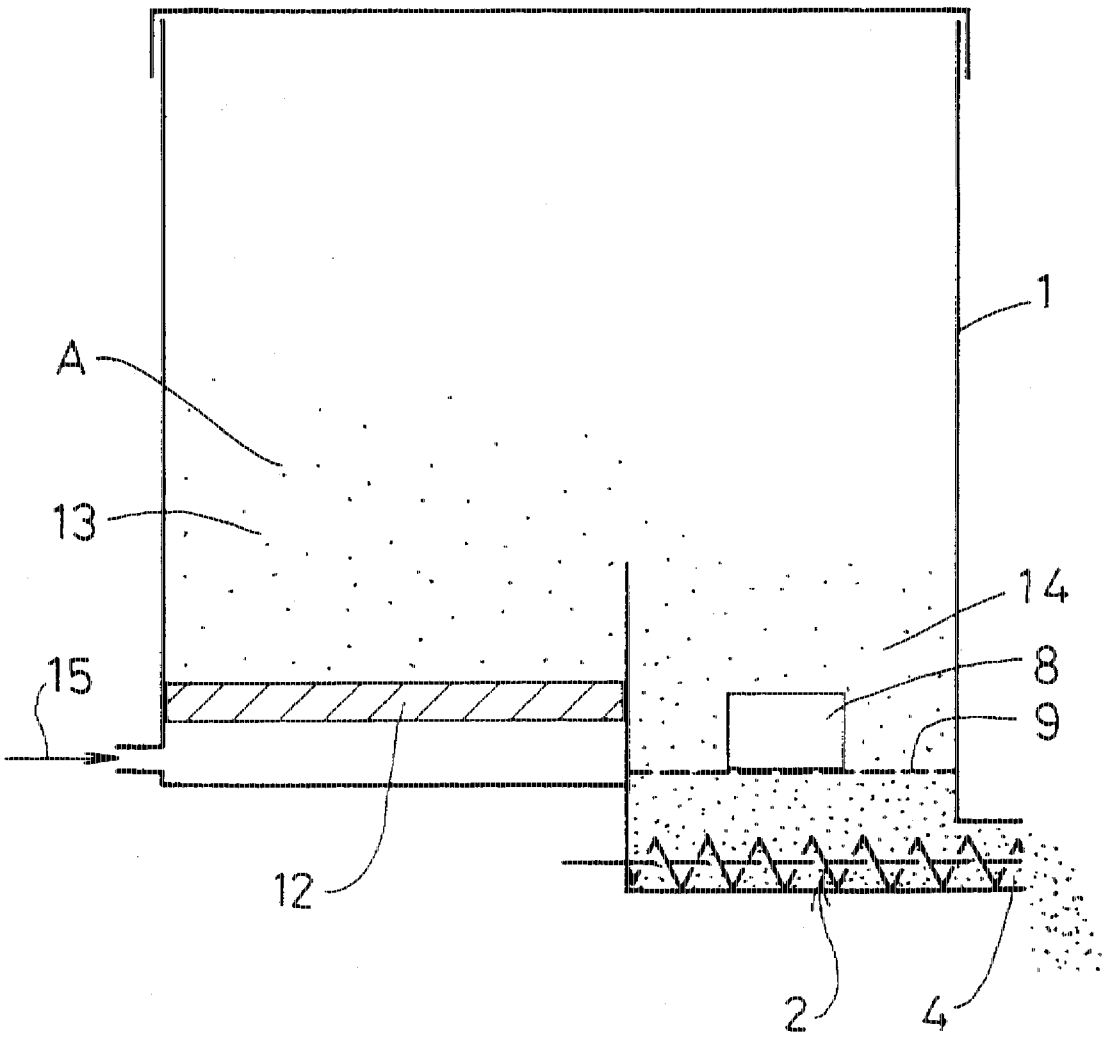
FIG. 4 is a schematic view of a fourth embodiment of the present invention.

In the fourth embodiment shown in FIG. 4, the interior of the powder container 1 is divided into a first chamber 13 in which the powder is stirred by air 15 supplied through a porous bottom plate 12, and a second chamber 14 in which air is not supplied and the powder is kept stationary. As shown in FIG. 4, an interior wall structure extends between the wire net 9 and the porous bottom plate 12. In this arrangement, the powder A is loosened in the first chamber 13 by being stirred by air, and is then allowed to settle in the second chamber 14. Thus, air present between the particles of powder A can escape smoothly while in the second chamber 14, so that the amount of powder per unit volume becomes uniform. A wire net 9 is stretched across the interior of the second chamber 14. The wire net 9 carries a vibrator 8. By activating the vibrator 8, it is possible to smoothly separate air which is present between the particles of powder A.

A screw feeder 2 is provided on the bottom of the second chamber 14 to discharge the powder A from the chamber 14 at a constant rate.

Figure 5:
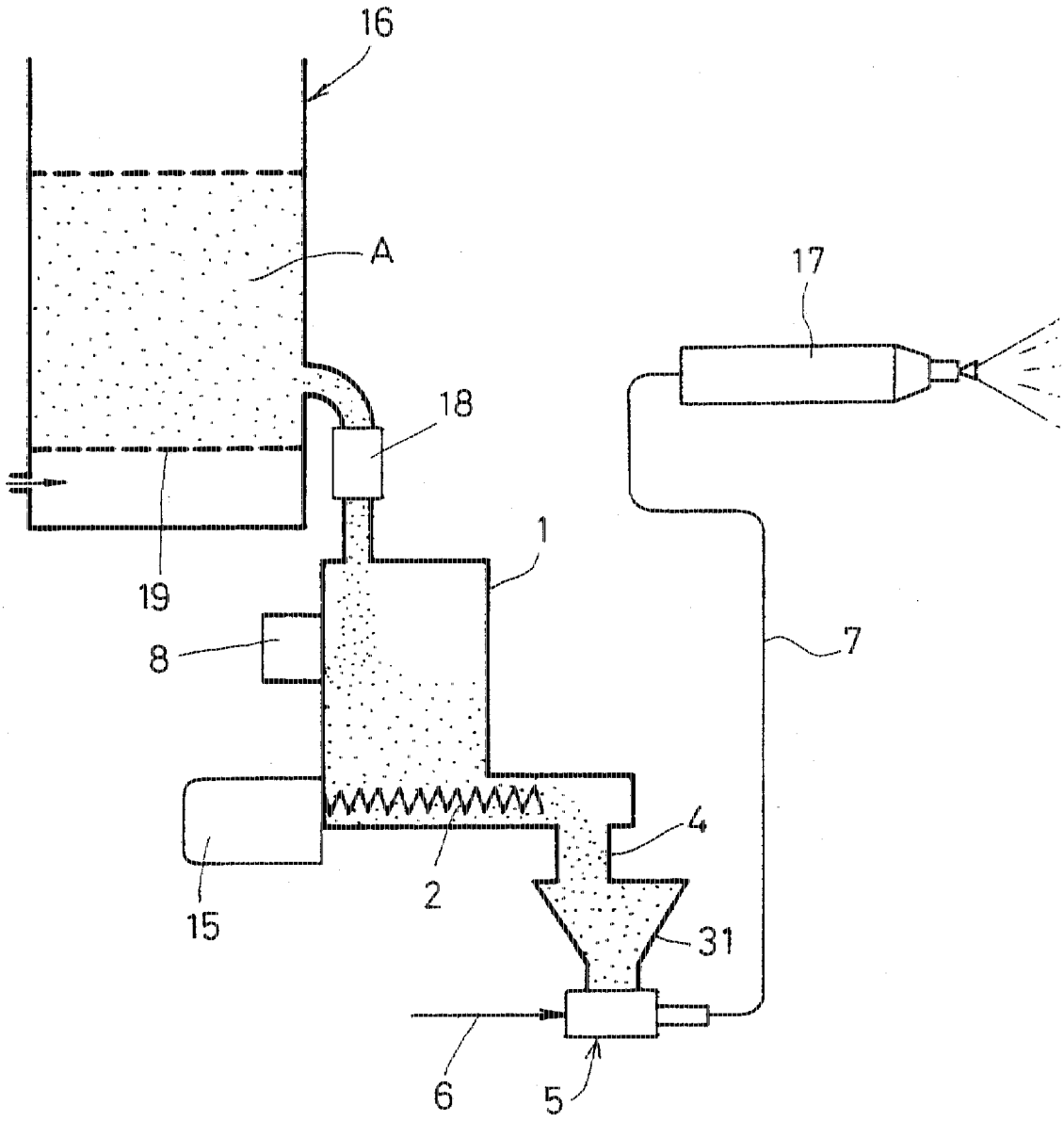
FIG. 5 is a schematic view of a fifth embodiment of the present invention.

FIG. 5 shows a paint powder feed line including a screw feeder. A paint powder A is supplied from a paint tank 16 to a paint powder gun 17 in the following manner.

The paint powder A in the paint powder tank 16 is fed into a powder container 1 through a valve 18 such as a pinch valve or a bellows valve. A porous inner bottom plate 19 is provided above the bottom of the tank 16. Air from a compressor is circulated in the space under the bottom plate 19 to break lumps of powder A in the tank 16 and to dehumidify the powder.

The valve 18, provided between the tank 16 and the container 1, is not an essential element and may be omitted.

A screw feeder 2 is provided in the powder container 1 for feeding paint powder A to a discharge port 4 formed in the bottom of the powder container 5'. The paint powder A is discharged from the discharge port 4 at a constant rate that is determined by the revolving speed of the screw feeder 2. The screw feeder 2 is driven by a motor 15.

A vibrator 8 is mounted on the wall of the powder container 1. By vibrating the powder container 1 with the vibrator 8, it is possible to smoothly separate air contained in the paint powder A. Thus, at the lower portion of the powder container 1, the amount of paint powder A per unit volume becomes uniform.

Figure 6:
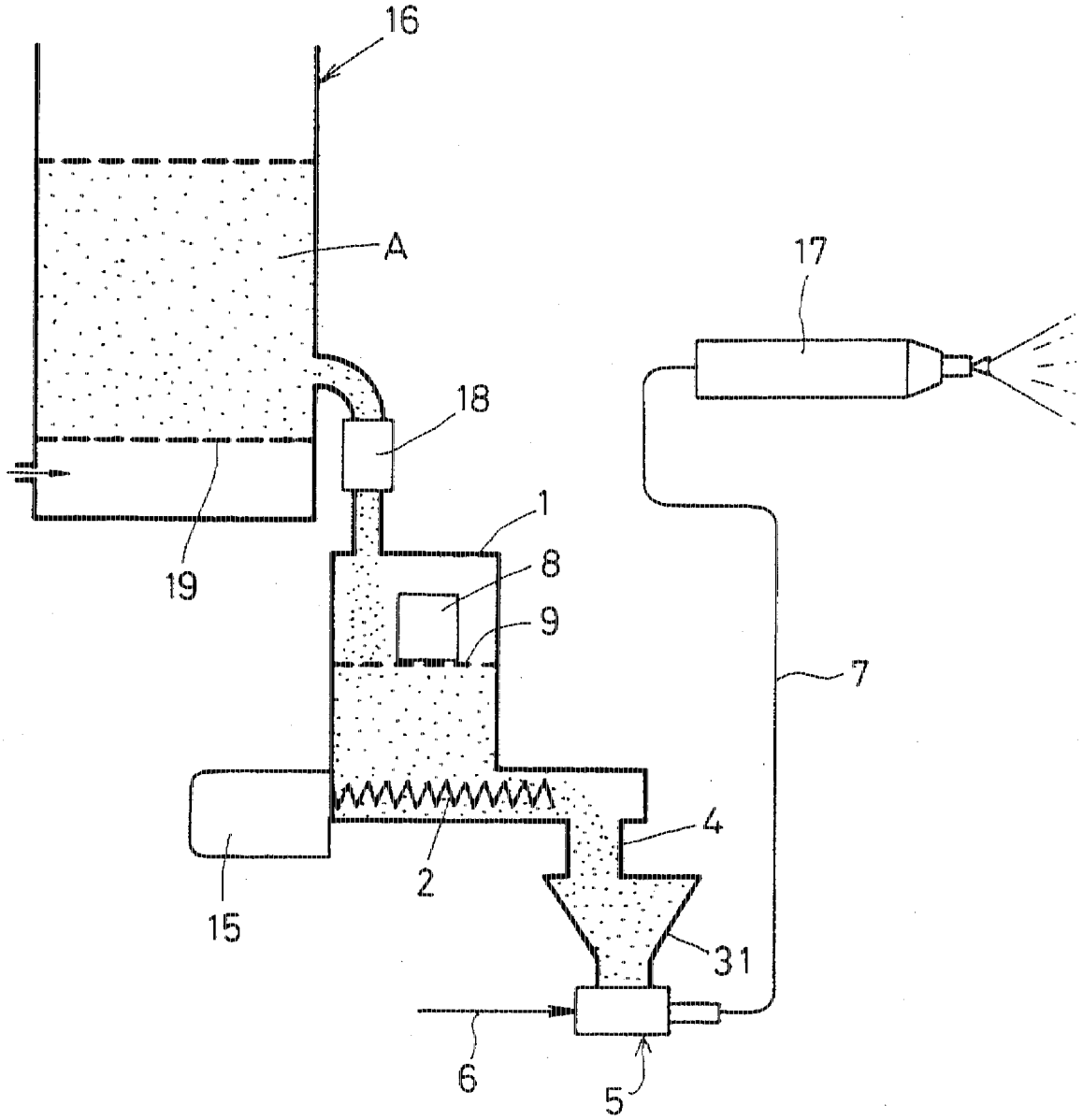
FIG. 6 is a schematic view of a modified embodiment of the fifth embodiment.

Instead of mounting the vibrator 8 on the wall of the powder container 1, it may be mounted on a wire net 9 stretched across the interior of the powder container 1 as shown in FIG. 6. By vibrating the wire net 9 with the vibrator 8, it is possible to vibrate the paint powder A in the powder container 1 more effectively, so that air in the paint powder A separates more quickly.

The vibrator 8 may be activated continuously or intermittently.

The paint powder A discharged by the screw feeder 2 drops into a hopper 31 of an injector 5 and is carried by carrier air 6 through a hose 7 to the powder painting gun 17.

Figure 7:
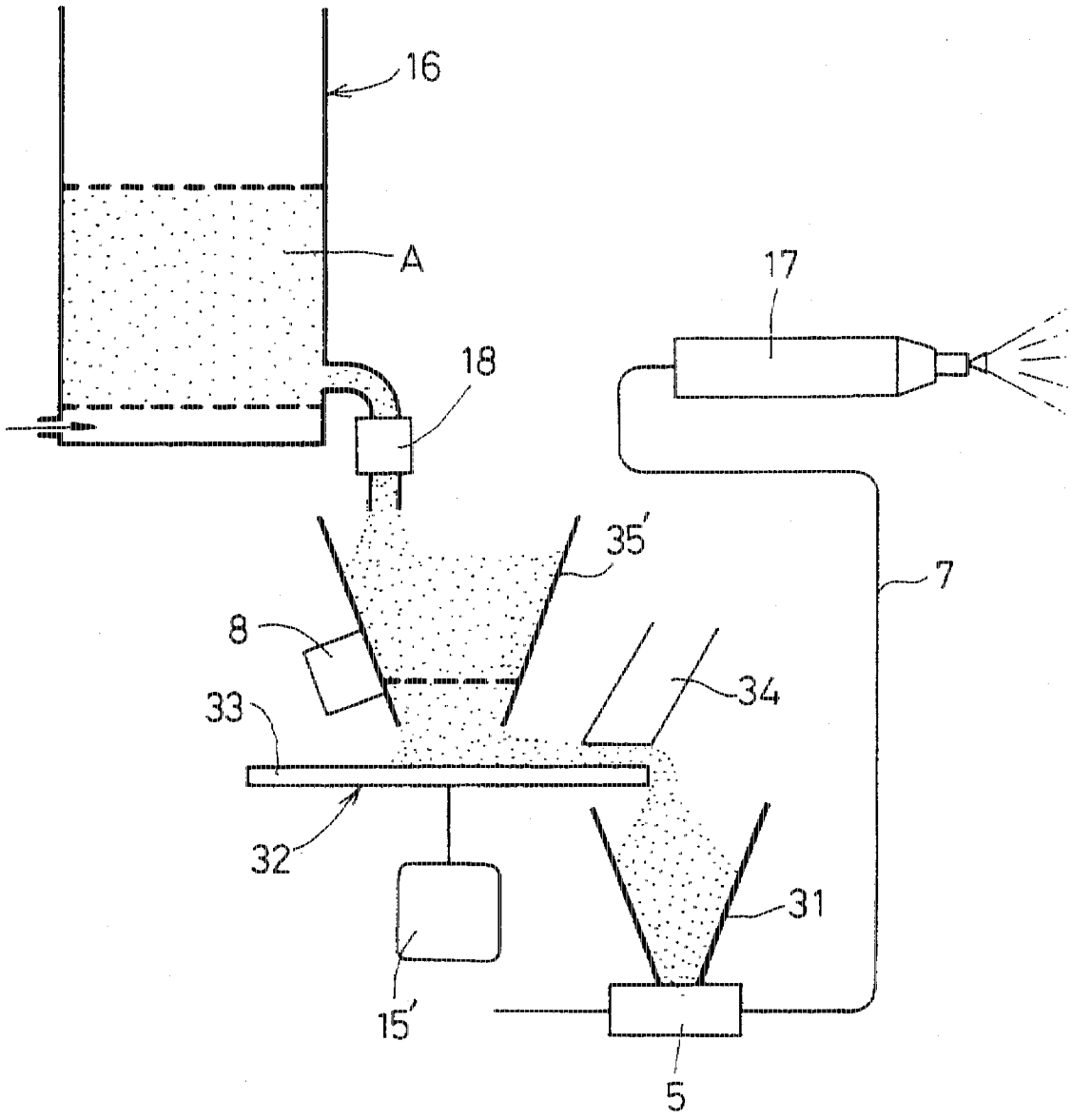
FIG. 7 is a schematic view of a sixth embodiment of the present invention.
Figure 8:
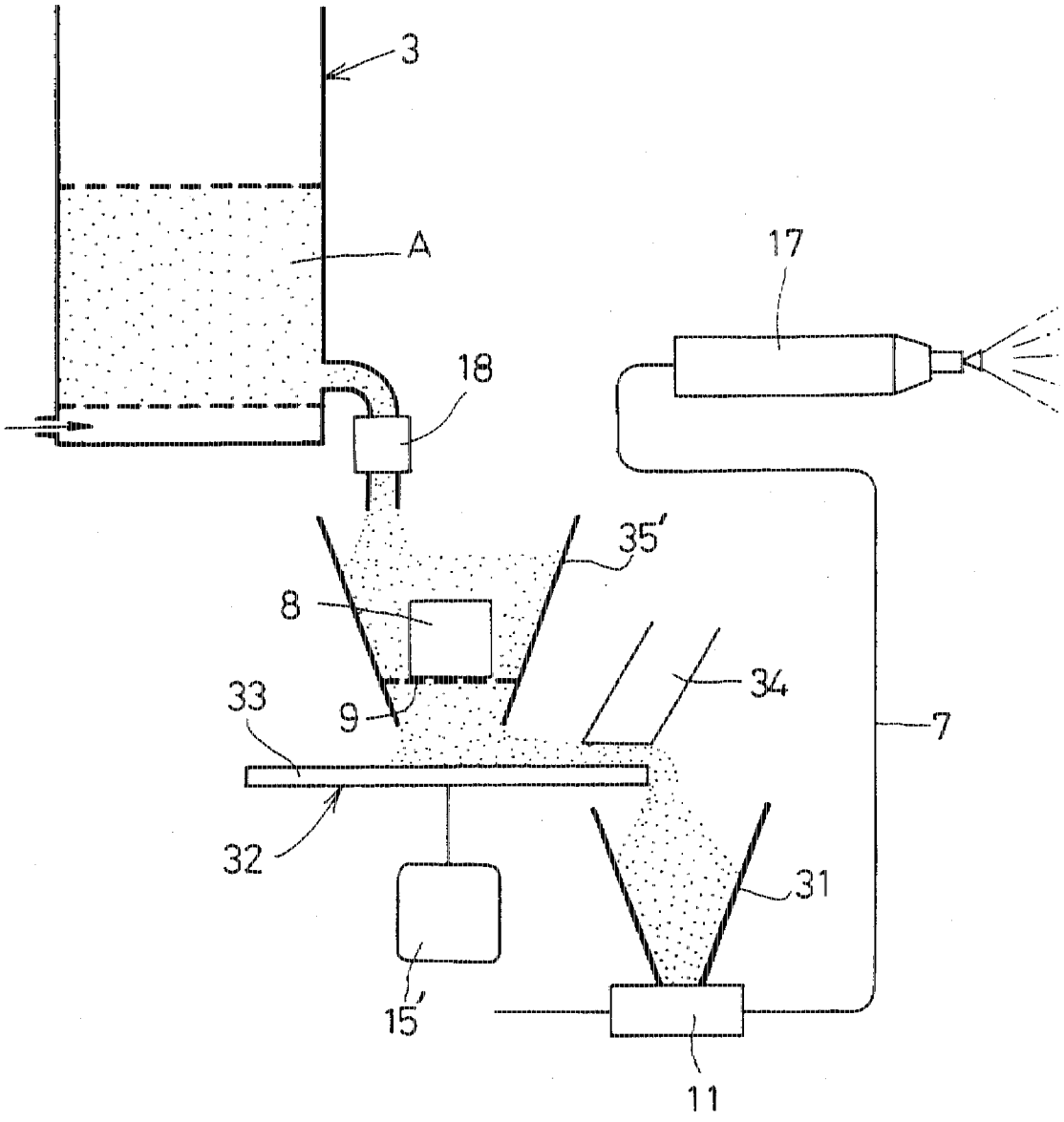
FIG. 8 is a schematic view of a modified embodiment of the sixth embodiment.
Figure 9:
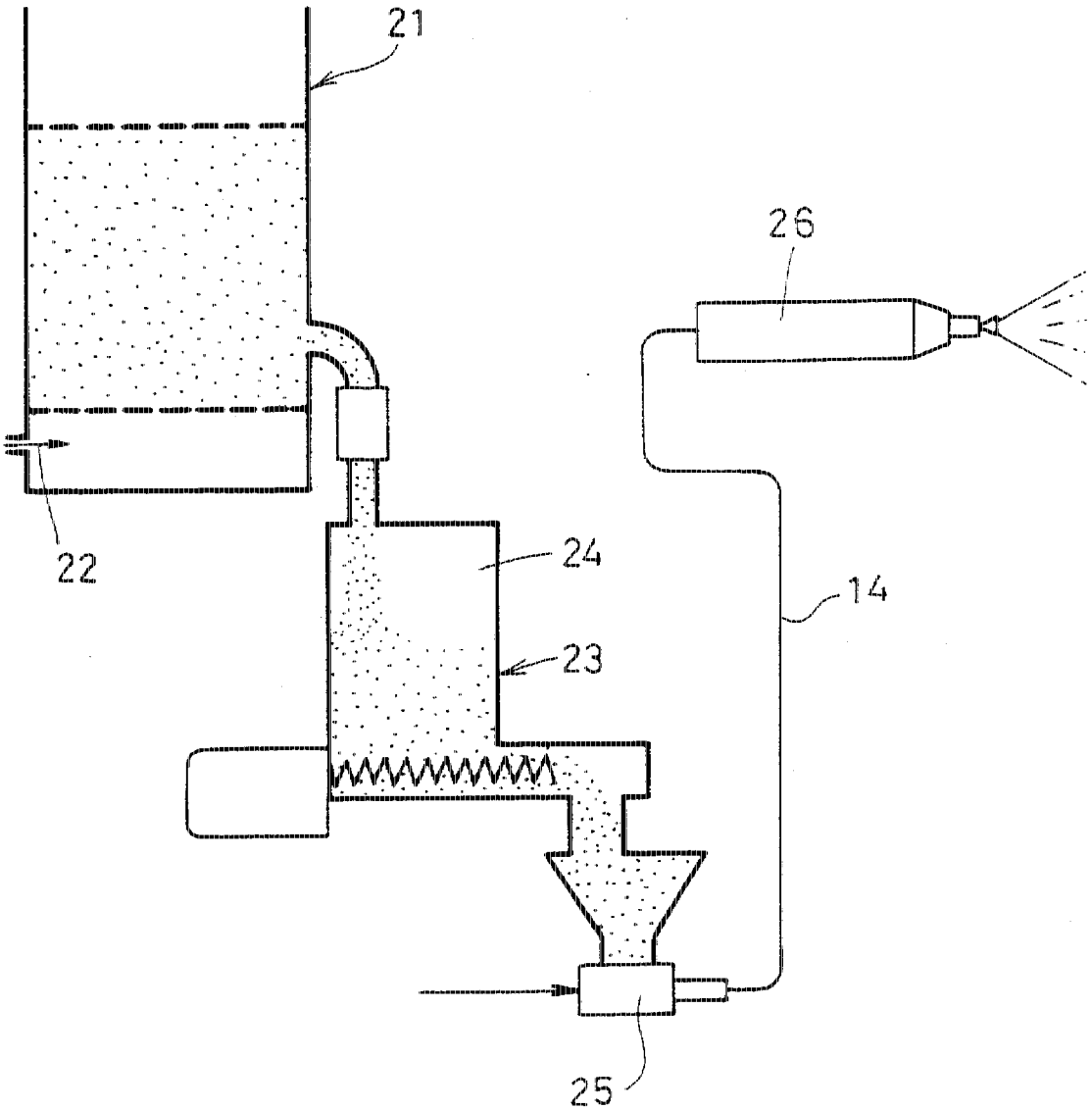
FIG. 9 PRIOR ART
FIG. 9 is a schematic view of a conventional feeder.
Figure 10:
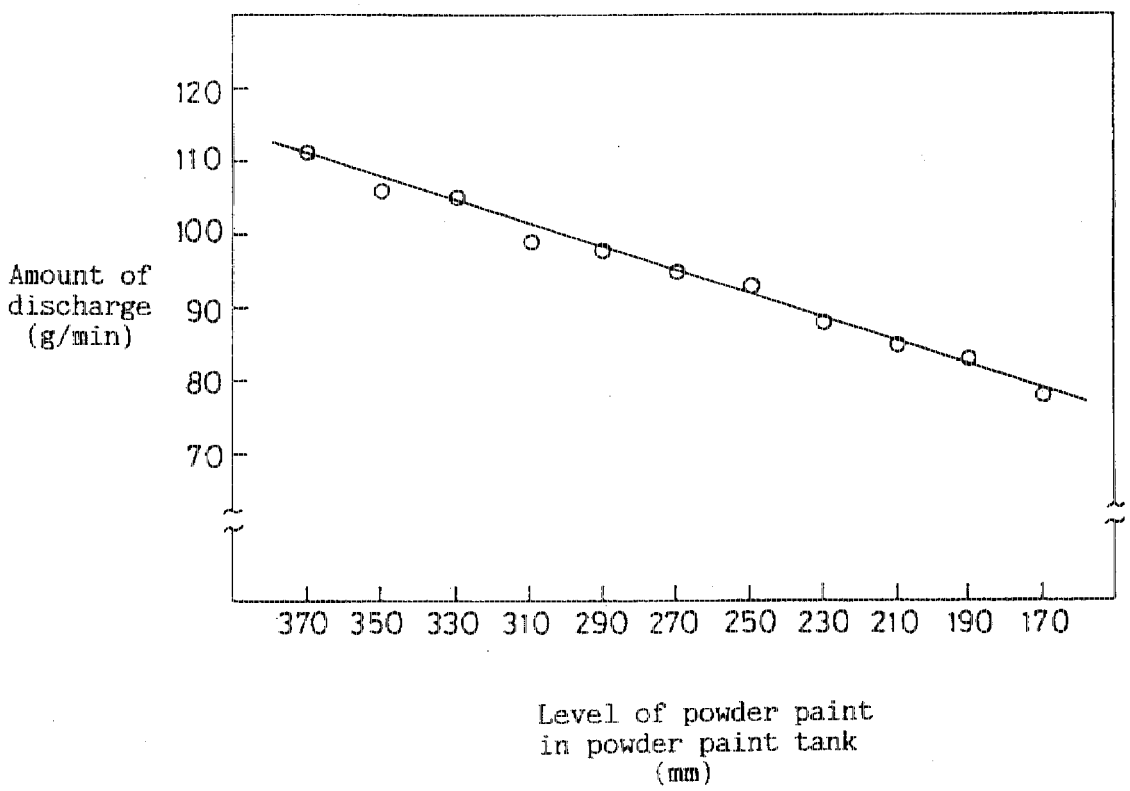
FIG. 10 is a graph showing how the amount of powder discharged changes with the level of powder paint in a powder paint tank.

In the sixth embodiment shown in FIG. 7, the discharge device for discharging paint powder A is a table feeder 32 which includes a hopper type powder container 35, and a rotary table 33 provided under the powder container 35. Paint powder A, spread on the rotary table 33 to an even thickness, can be supplied to a next station at a constant rate by scraping it with a scraper 34. Otherwise, this embodiment is structurally identical to the third embodiment. A vibrator 8 is mounted on the wall of the powder container 35 (FIG. 7) or on a wire net 9 stretched across the interior of the powder container 35' (FIG. 8). The rotary table 33 is driven by a motor 15'.

We measured the amount of powder discharged from the painting gun 17 of the embodiment shown in FIG. 5 when the vibrator 8 is activated and when the vibrator 8 is not activated. The resulting measurements are shown in Tables 3 and 4.

Table 3 shows the measurements when a polyester (white) paint powder, stored in the tank to the level of 400 mm, is discharged with the discharge rate set at 160 g/min. Table 4 shows the measurements when an epoxy (black) paint powder stored in the powder paint tank to the level of 400 mm, is discharged with the discharge rate set at 120 g/min.

From the results of Tables 3 and 4, it is apparent that the discharge rate of powder from the powder painting gun can be kept constant by separating air trapped between the particles of powder by vibrating the vibrator 8.

According to this invention, air is separated from the powder in the powder container by the time it reaches the lower portion of the powder container where there is provided a discharge device such as a screw feeder or a table feeder, so that at the lower portion of the container, the amount of powder per unit volume is sufficiently uniform. Thus, it is possible to discharge powder from the container at a constant rate irrespective of the amount of air contained in the powder supplied into the container.

[TABLE 1]

| Elapsed time (min) | Discharged amount (g/min) Without vibrator | With vibrator |
|---|---|---|
| At start | 140, 142, 140 | 155, 157, 156 |
| 30 | 151, 152, 153 | 156, 157, 157 |
| 60 | 140, 138, 136 | 154, 155, 157 |
| 90 | 142, 138, 137 | 154, 157, 155 |
| 120 | 162, 164, 160 | 157, 157, 154 |
| 150 | 140, 140, 144 | 152, 155, 153 |
| 180 | 152, 154, 150 | 155, 155, 152 |
| 210 | 164, 163, 160 | 157, 158, 158 |
| 240 | 141, 138, 139 | 152, 152, 151 |
| 270 | 150, 144, 148 | 153, 155, 155 |
| 300 | 160, 165, 164 | 155, 158, 157 |
| 330 | 141, 140, 144 | 150, 154, 155 |
| 360 | 154, 157, 160 | 155, 157, 154 |

[TABLE 2]

| Elapsed time (min) | Discharged amount (g/min) Without vibrator | With vibrator |
|---|---|---|
| At start | 122, 126, 125 | 135, 140, 138 |
| 30 | 135, 137, 138 | 140, 139, 138 |
| 60 | 139, 139, 135 | 142, 140, 140 |
| 90 | 120, 119, 119 | 140, 138, 138 |
| 120 | 122, 127, 125 | 138, 138, 138 |
| 150 | 119, 118, 109 | 135, 140, 136 |
| 180 | 120, 122, 109 | 140, 135, 135 |
| 210 | 130, 133, 135 | 140, 140, 137 |
| 240 | 115, 117, 119 | 139, 137, 141 |
| 270 | 105, 107, 106 | 135, 137, 140 |
| 300 | 130, 129, 125 | 140, 140, 137 |
| 330 | 120, 125, 130 | 141, 135, 137 |
| 360 | 108, 109, 105 | 140, 135, 135 |

[TABLE 3]

| Level of powder paint in the tank (mm) | Discharged amount (g/min) Without vibrator | With vibrator |
|---|---|---|
| 150 | 133, 132, 131 | 161, 163, 161 |
| 200 | 139, 137, 138 | 158, 159, 161 |
| 250 | 142, 146, 146 | 160, 157, 156 |
| 300 | 149, 148, 149 | 159, 158, 160 |
| 350 | 153, 155, 156 | 160, 162, 162 |
| 400 | 160, 163, 161 | 160, 162, 160 |

[TABLE 4]

| Level of powder paint in the tank (mm) | Discharged amount (g/min) Without vibrator | With vibrator |
|---|---|---|
| 150 | 80, 82, 85 | 120, 123, 121 |
| 200 | 88, 89, 87 | 119, 116, 119 |
| 250 | 93, 94, 93 | 120, 115, 118 |
| 300 | 99, 103, 102 | 121, 122, 120 |
| 350 | 110, 113, 112 | 120, 115, 118 |
| 400 | 120, 122, 120 | 120, 120, 122 |

What is claimed is:

1. A powder feeding device for feeding powder at a constant rate, said powder feeding device comprising:

a powdered material container having a bottom wall and a discharge opening located in a lower portion of said container;

a discharge means mounted in said lower portion of said container for discharging material from said container at a constant rate;

a wire net fixedly mounted in said container so as to divide said container into an upper chamber and a lower chamber, wherein powder can accumulate in said lower chamber; and a vibrator mounted on said wire net such that the accumulated powder in said lower chamber will have an increased density relative to powder in said upper chamber.

2. The powder feeding device as claimed in claim 1, wherein said discharge means is a screw feeder.

3. The powder feeding device as claimed in claim 1, further comprising a supply of powdered paint located within said container.

4. The powder feeding device as claimed in claim 3, wherein said discharge means is a screw feeder.

5. A powder feeding device for feeding powder at a constant rate, said powder feeding device comprising:

a powdered material container having a discharge opening located adjacent a bottom wall of said container;

a wall structure extending from said lower portion of said container into an interior of said container so as to divide said container into a first chamber and a second chamber;

a wire net fixedly mounted in said second chamber of said container above said bottom wall and between an interior wall surface of said container and said wall structure;

a vibrator mounted on said wire net for vibrating said net to release air from the powder flowing from said first chamber and accumulating in said second chamber such that the density of the powder in said second chamber will be greater than the density of the powder in said first chamber;

a porous bottom plate located at a lower portion of said first chamber between said interior wall structure and an interior wall surface of said container;

an air inlet provided in said lower portion of said container between a bottom wall of said container and said porous bottom plate; and a discharge means mounted in said second chamber of said container adjacent said discharge opening for discharging material from said container at a constant rate.

6. A powdered paint feeding device comprising:

a powdered paint tank having a bottom, a porous bottom plate provided above said bottom, and an air inlet located between said bottom and said porous bottom plate;

a powdered paint container, in fluid communication with said tank, having an inlet and a discharge opening formed in a bottom wall of said container;

a wire net fixedly mounted in said container and defining an upper chamber and a lower chamber;

a powdered paint discharge device mounted in said lower chamber adjacent said discharge opening; and a vibrator mounted on said wire net for vibrating said wire net and effecting flow of powder from said upper chamber to said lower chamber such that powder will accumulate in said lower chamber and have a higher density than powder in said upper chamber.

7. The powdered paint feeding device as claimed in claim 6, wherein said discharge device is a screw feeder.

8. The powdered paint feeding device as claimed in claim 5, wherein said discharge device is a rotatable table feeder.

9. A powder feeding device for feeding powder at a constant rate, said powder feeding device comprising:

a powdered material container having a discharge opening located in a lower portion of said container;

a rotary table feeder disposed adjacent said discharge opening for discharging material from said container at a constant rate;

a wire net fixedly mounted in said container so as to divide said container into an upper chamber and a lower chamber, wherein powder can accumulate between said wire net and said rotary table feeder; and a vibrator mounted on said wire net for vibrating said wire net to release air from powder flowing from said upper chamber so as to increase the density of the accumulated powder relative to the powder in said upper chamber.

10. A powdered paint feeding device comprising:

a powdered paint tank having a bottom, a porous bottom plate provided above said bottom, and an air inlet located between said bottom and said porous bottom plate;

a powdered paint container, in fluid communication with said tank, having an inlet and a discharge opening formed in a of said container;

a wire net fixedly mounted in said container and defining an upper chamber and a lower chamber;

a powdered paint rotatable table feeder positioned adjacent said discharge opening such that powder flowing through said wire net can accumulate between said table feeder and said discharge opening;

a vibrator mounted on said wire net for vibrating said wire net and effecting flow of powder from said upper chamber to said lower chamber such that the accumulated powder will have a higher density relative to powder in said upper chamber.

* * * * *